US006908525B2

(12) United States Patent
Anderson et al.

(10) Patent No.: US 6,908,525 B2
(45) Date of Patent: Jun. 21, 2005

(54) APPARATUS FOR FORMING A ROLL OF CONTAMINANT REMOVAL TAPE AND METHODS OF FORMING ROLLS OF CONTAMINANT REMOVAL TAPE

(75) Inventors: Andrew C. Anderson, Hudson, WI (US); Henry J. Elmer, Amery, WI (US); Derrick H. Fouks, Deer Park, WI (US); Mark J. Shimko, Cambridge, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 365 days.

(21) Appl. No.: 10/167,320

(22) Filed: Jun. 11, 2002

(65) Prior Publication Data

US 2003/0226636 A1 Dec. 11, 2003

(51) Int. Cl.[7] ..... B32B 31/00

(52) U.S. Cl. ..... 156/187; 156/191; 156/446; 156/458; 156/459; 242/533.2; 242/533.4; 242/533.5

(58) Field of Search ..... 156/446, 458, 156/459, 184, 187, 191; 242/533.2, 533.4, 533.5; 15/104.002

(56) References Cited

U.S. PATENT DOCUMENTS

| | | | | |
|---|---|---|---|---|
| 3,127,122 A | | 3/1964 | Roshkind | |
| 3,549,097 A | | 12/1970 | Seigh | |
| 3,844,501 A | * | 10/1974 | Spencer | 242/533.4 |
| 3,899,075 A | * | 8/1975 | Hall et al. | 242/160.4 |
| 3,906,578 A | | 9/1975 | Huber | |
| 4,422,201 A | | 12/1983 | McKay | |
| 4,905,337 A | | 3/1990 | McKay | |
| 5,027,465 A | | 7/1991 | McKay | |
| 5,388,300 A | | 2/1995 | Hickey | |
| 5,620,544 A | | 4/1997 | Cram et al. | |
| 5,763,038 A | | 6/1998 | Wood | |
| 5,878,457 A | * | 3/1999 | Cox et al. | 15/104.002 |
| 5,885,391 A | | 3/1999 | Cram et al. | |
| 5,934,602 A | | 8/1999 | Jendroska et al. | |
| 5,940,921 A | * | 8/1999 | Wood et al. | 15/104.002 |
| 6,055,695 A | | 5/2000 | McKay, Jr. | |
| 6,127,014 A | | 10/2000 | McKay, Jr. | |
| 6,270,034 B1 | * | 8/2001 | Kury et al. | 242/533.4 |
| 6,308,908 B1 | | 10/2001 | Marchante | |
| 2001/0035474 A1 | | 11/2001 | Kury et al. | |

FOREIGN PATENT DOCUMENTS

| | | | |
|---|---|---|---|
| EP | 1048597 A2 | * | 11/2000 |
| FR | 2 320 886 | | 3/1977 |
| WO | WO 96/40578 | | 12/1996 |
| WO | WO-01/146051 A1 | * | 6/2001 |

* cited by examiner

*Primary Examiner*—Jeff H. Aftergut
(74) *Attorney, Agent, or Firm*—David B. Patchett

(57) ABSTRACT

An apparatus for forming a roll of contaminant removal tape and methods of forming rolls of contaminant removal tape. The apparatus includes a turret assembly having a first winding cylinder, a first vacuum source providing vacuum to the first winding cylinder, and a web breaking assembly moveable between a first web breaking assembly position and a second web breaking assembly position. The web breaking assembly includes a blade, which is moveable between a first blade position and a second blade position.

40 Claims, 9 Drawing Sheets

APPARATUS FOR FORMING A ROLL OF CONTAMINANT REMOVAL TAPE AND METHODS OF FORMING ROLLS OF CONTAMINANT REMOVAL TAPE

TECHNICAL FIELD

The present invention relates generally to an apparatus for forming a roll of contaminant removal tape and methods of forming rolls of contaminant removal tape. The present invention relates more particularly to an apparatus for forming a roll of contaminant removal tape including a turret assembly having a first winding cylinder, a first vacuum source providing vacuum to the first winding cylinder, and a web breaking assembly moveable between a first web breaking assembly position and a second web breaking assembly position, where the web breaking assembly includes a blade, where the blade is moveable between a first blade position and a second blade position, and methods of using such an apparatus to form rolls of contaminant removal tape.

BACKGROUND OF THE INVENTION

A variety of lint removal devices and methods of making such lint removal devices are known. Lint removal devices remove lint and other small particles or contaminants, such as hair or threads, from a surface, such as clothing. One known form of a lint removal device includes lint removal tape, which is used while still on a roll to remove lint and other small particles from the surface. In roll form, lint removal tape is typically wound on a core with the adhesive side of the tape wound outwardly for use. The lint removal tape roll is rolled against the surface to remove the lint and other small particles or contaminants from the surface. The lint, small particles and other contaminants adhere to the adhesive side of the lint removal tape. When the outer wrap of the lint removal tape is saturated with the lint, small particles and other contaminants, the outer wrap of the tape is removed from the roll to discard it. A roll of lint removal tape is generally used on an applicator.

U.S. Pat. No. 5,940,921 (Wood et al.), "Applicator for a Coreless Tape Roll," describes an applicator for a lint removal device that includes a handle portion connected to a tape-receiving portion. The tape-receiving portion includes a tape-receiving surface, an inner lip, a tapered outer lip, and grooves adjacent the lips. This patent also describes a roll of lint removal tape. In column 2, lines 41–43 of the patent, the lint removal tape is described as including a backing that could be made of backing material which is compostible or degradable, could be colored, could be printed, or could be of different surface textures or embossed, without providing any additional details as to which side is embossed.

U.S. Pat. No. 5,763,038 (Wood), "Progressively Perforated Tape Roll," describes a tape including a backing layer and an adhesive layer formed on the backing layer. A plurality of lines of perforations extend across the tape to separate the tape into sheets. The sheets have progressively increasing lengths such that when the sheets are wound into a roll, each sheet is longer than the sheet underneath it. When in a roll, the outermost sheet covers all of the lines of perforations to reduce instances of the tape tearing in a downweb direction.

Other lint removal devices are described in U.S. Pat. No. 6,055,695, U.S. Pat. No. 6,127,014, U.S. Pat. No. 5,388,300, U.S. Pat. No. 5,027,465, U.S. Pat. No. 4,905,337, U.S. Pat. No. 4,422,201, and U.S. Pat. No. 3,906,578.

3M Company based in St. Paul, Minn. has sold lint rollers and roller refills in a variety of sizes under the brand name "3M" under part numbers 836, 837, and 833. These "regular size" lint rolls have typically included an inner diameter of 1.76 inches (4.47 cm), an outer diameter in the range of 1.8 inches (4.57 cm) to 2.5 inches (6.35 cm), and a width of 4 inches (10.16 cm). The mini lint rolls, sold under 3M brand, part number 836, typically have an inner diameter of 0.89 inches (2.26 cm), an outer diameter of 1.1 inches (2.79 cm), and a width of 3 inches (7.62 cm).

Helmac Products Corporation, based in Flint, Mich. has sold lint adhesive rollers and adhesive roller refills in a variety of sizes under the brand name "Evercare." These lint rolls including the core have typically included an inner diameter of 1.5 inches (3.81 cm), an outer diameter in the range of 1.6 in. (4.06 cm) to 2.4 in. (6.1 cm), and a width of 4 inches (10.16 cm). Helmac Products Corporation also has sold mini-lint rolls, sold typically as a "Trial Size Roll", which have typically included an inner diameter of 0.84 inches (2.13 cm), an outer diameter of 1.0 inches (2.54 cm), and a width of 3 inches (7.62 cm).

PCT publication WO 96/40578 A1 "Coreless Adhesive Tape Winding Mandrel and Method," (Ogren et al.), describes a method and apparatus for forming a plurality coreless rolls of pressure sensitive adhesive tape, formed simultaneously, involving the use of a mandrel assemblies having a specific circumferential tape supporting segment thereon for winding tape. The circumferential tape supporting segments have a tape engaging surface portion that, in a radial orientation, is compressible yet sufficiently stiff to support the tape as it is successively wound about the mandrel to form a tape roll, and that is sufficiently pliant to permit ready axial removal of a wound tape roll from the mandrel. The innermost wrap of pressure sensitive adhesive tape about the mandrel is masked by an adhesive liner. Multiple rotatably driven winding mandrels are advanced through successive stations by a turret assembly. The functional aspects of the five mandrel stations include a mandrel loading position, a ready position, a winding position, a transfer position, and a mandrel unloading position. When winding of a roll upon a mandrel is nearly complete, the turret assembly advances the mandrel from the winding position to the transfer position. Once the leading edge of the adhesive liner is detected, an enveloper assembly pivots to envelop the web of tape around the mandrel at the winding position and a knife assembly, opposite the enveloper assembly, also pivots towards the web of tape material. The tape web is held in tension by the enveloper and knife assemblies, which are merged together around the winding mandrel. A knife blade extends from the knife assembly and severs the tape web at the leading edge of the adhesive liner, thus creating the innermost wrap of a new coreless roll of tape. System control is preferably achieved through the use of a microprocessor which is operatively coupled to the various motors and actuators.

There are also various patents describing apparatuses and method for forming tape rolls. For example, U.S. Pat. No. 5,885,391, "Tape Roll Liner/Tab Application Apparatus and Method," (Cram et al.), describes a method and apparatus for longitudinally advancing a web having pressure sensitive adhesive on a first side and providing a supply of liner/tab strip. Then advancing the liner/tab strip from the supply laterally across the longitudinally advancing web adjacent the first, adhesive bearing side. The breaking the liner/tab strip to a length approximating the lateral width of the web, and urging a leading lateral edge portion of the cut liner/tab strip against the first adhesive bearing side of the advancing web to cause adherence to the adhesive side of the web. Finally urging the remainder of the cut liner/tab strip against the advancing web as the web carries the liner/tab strip away longitudinally. The method further comprises: periodically repeating the advancing, breaking and both urging steps as the web is advanced past the supply of liner/tab strip. Pressure sensitive adhesive tape wound with its adhesive side out requires no liner on innermost wrap to prevent adhesive from engaging winding mandrel, since non-adhesive side of tape faces winding mandrel. Thus, it is contemplated that no liner be provided for innermost wrap, in which instance adhesion by wrapping about winding mandrel would begin with second wrap.

U.S. Pat. No. 5,620,544, "Tape Roll Liner/Tab Application Apparatus and Method," (Cram et al.), describes a process for sequentially forming a plurality of coreless rolls of pressure sensitive adhesive tape comprising the steps of: longitudinally advancing a web having first and second major surfaces, one surface thereof bearing pressure sensitive adhesive thereon, applying a liner/tab across a lateral width of the advancing web on the adhesive-bearing surface thereof, winding the advancing web about a mandrel member to define a tape roll, whereby an innermost wrap of the web for each tape roll includes an extent of the liner/tab sufficient to mask any exposed adhesive, and breaking the liner/tab and web laterally into two segments, a first segment of the liner/tab defining said extent for one tape roll, and a second segment of the liner/tab defining a mask for adhesive along at an outermost end portion of a web for a previously wound tape roll.

SUMMARY OF THE INVENTION

One aspect of the present invention provides an apparatus for forming a roll of contaminant removal tape. The apparatus for forming a roll of contaminant removal tape comprises: a turret assembly including a first winding cylinder; a first vacuum source providing vacuum to the first winding cylinder; and a web breaking assembly moveable between a first web breaking assembly position and a second web breaking assembly position, where the web breaking assembly includes a blade, where the blade is moveable between a first blade position and a second blade position.

In one preferred embodiment of the above apparatus, the first winding cylinder travels along a winding cylinder path, where the first web breaking assembly position is away from the winding cylinder path and the second web breaking assembly position is in the winding cylinder path, and where the first blade position is distant from a web path and the second blade position is in the web path. In one aspect of this embodiment, the web breaking assembly further comprises: a first actuator for moving the web breaking assembly between the first web breaking assembly position and the second web breaking assembly position; and a second actuator for moving the blade between the first blade position and the second blade position. In another aspect of this embodiment, the turret assembly further includes a second winding cylinder, and where the second winding cylinder travels along the winding cylinder path. In yet another aspect of this embodiment, the first winding cylinder includes a first end, a second end opposite the first end, a cylinder wall, and a plurality of holes in the cylinder wall, where the first end is attached to the turret assembly, where the first vacuum source provides vacuum to the first end of the first winding cylinder and to the plurality of holes; and where the apparatus further comprises a support arm assembly, where the support arm assembly is movable between a first position distant from the second end of the first winding cylinder and a second position to engage with the second end of the first winding cylinder.

In another aspect of the above embodiment, the apparatus includes a second vacuum source for providing vacuum to the second end of the first winding cylinder and to the plurality of holes. In yet another aspect of the above embodiment, the turret assembly further includes a second winding cylinder, and where the second winding cylinder travels along the winding cylinder path, where the support arm assembly includes an extension member for engaging with the second end of the first winding cylinder, where the extension member is movable between the first position distant from the second end of the second winding cylinder and the second position to mate with the second end of the second winding cylinder.

In another preferred embodiment of the above apparatus, the apparatus further comprises a web guide movable between a first web guide position and a second web guide position, where the first web guide position is away from the winding cylinder path and the second web guide position is in the winding cylinder path. In one aspect of this embodiment, the web guide is attached to the web breaking assembly, where the web guide and the web breaking assembly are moveable together between the first position and the second position. In another preferred embodiment of the above apparatus, the apparatus includes a length of contaminant removal tape, where the length of tape includes a first side and second side opposite the first side, where the second side includes a layer of adhesive, and the tape is wrapped around the first winding cylinder such that the layer of adhesive faces outwardly from the first winding cylinder.

The present invention provides an alternative apparatus for forming a roll of contaminant removal tape. This apparatus comprises: a turret assembly including a first winding cylinder, where the first winding cylinder includes a first end, a second end opposite the first end, a cylinder wall, and a plurality of holes in the cylinder wall, and where the first end is attached to the turret assembly; a first vacuum source, where the first vacuum source provides vacuum to the first end of the first winding cylinder and to the plurality of holes; and a support arm assembly where the support arm assembly is movable between a first position distant from the second end of the first winding cylinder and a second position to engage with the second end of the first winding cylinder.

In one preferred embodiment of the above apparatus, the apparatus includes a second vacuum source for providing vacuum to the second end of the first winding cylinder and to the plurality of holes. In another preferred embodiment of the above apparatus, the support arm assembly includes a extension member for engaging with the second end of the first winding cylinder, where the extension member is movable between the first position distant from the second end of the first winding cylinder and the second position to mate with the second end of the first winding cylinder. In another preferred embodiment of the above apparatus, the apparatus further comprises an actuator for moving the extension member between the first position and the second position.

In yet another preferred embodiment of the above apparatus, the apparatus further comprises a web breaking assembly moveable between a first web breaking assembly position and a second web breaking assembly position, where the web breaking assembly includes a blade, where the blade is moveable between a first blade position and a second blade position. In one aspect of this embodiment, the first winding cylinder travels along a winding cylinder path, where the first web breaking assembly position away from the winding cylinder path and the second web breaking assembly position is in the winding cylinder path, and where the first blade position is distant from a web path and the second blade position is in the web path. In another aspect of this embodiment, the apparatus further-comprises: a web guide movable between a first web guide position and a second web guide position, where the first web guide position is away from the winding cylinder path and the second web guide position is in the winding cylinder path. In yet another aspect of this embodiment, the web guide is attached to the web breaking assembly, where the web guide and the web breaking assembly are moveable together between the first position and the second position.

In another preferred embodiment of the above apparatus, the cylinder wall includes a first surface and a second surface opposite the first surface, where the second surface faces outwardly from the first winding cylinder, where the plurality of holes in the first winding cylinder have a first diameter in the first surface and a second diameter in the second surface, and where the second diameter is greater than the first diameter. In another preferred embodiment of the above apparatus, the apparatus includes a length of contaminant removal tape, where the length of tape includes a first side and second side opposite the first side, where the second side includes a layer of adhesive, and the tape is wrapped around the first winding cylinder such that the layer of adhesive faces outwardly from the first winding cylinder.

The present invention provides another alternative apparatus for forming a roll of contaminant removal tape. This apparatus comprises: a turret assembly including a first winding cylinder, where the first winding cylinder travels along a winding cylinder path; a web breaking assembly, and a web guide movable between a first web guide position and a second web guide position, where the first web guide position is away from the winding cylinder path and the second web guide position is in the winding cylinder path.

In one embodiment of the above apparatus, the web guide and the web breaking assembly are moveable together between the first position and the second position. In one aspect of this embodiment, the web guide is attached to the web breaking assembly. In another aspect of this embodiment, the web guide includes a roller for guiding the web between the web guide and the first winding cylinder after the winding cylinder has moved-from a first position to a second position along the winding cylinder path.

In another embodiment of the above apparatus, the web breaking assembly is moveable between a first web breaking assembly position and a second web breaking assembly position, where the web breaking assembly includes a blade, where the blade is moveable between a first blade position and a second blade position. In one aspect of this embodiment, the first winding cylinder travels along a winding cylinder path, where the first web breaking assembly position is away from the winding cylinder path and the second web breaking assembly position is in the winding cylinder path, and where the embodiment first blade position is distant from a web path and the second blade position is in the web path. In another of the above apparatus, the apparatus further comprises a first vacuum source and a second vacuum source, where the first winding cylinder includes a first end, a second end opposite the first end, a cylinder wall, and a plurality of holes in the cylinder wall, where the first end is attached to the turret assembly, where the first vacuum source provides vacuum to the first end of the first winding cylinder and to the plurality of holes, and where the second vacuum source provides vacuum to the second end of the first winding cylinder and to the plurality of holes; and where the apparatus further comprises a support arm assembly, where the support arm assembly is movable between a first position distant from the second end of the first winding cylinder and a second position to engage with the second end of the first winding cylinder.

In another embodiment of the above apparatus, the apparatus includes a length of contaminant removal tape, where the length of tape includes a first side and second side opposite the first side, where the second side includes a layer of adhesive, and the tape is wrapped around the first winding cylinder such that the layer of adhesive faces outwardly from the first winding cylinder.

The present invention provides yet another alternative apparatus for forming a roll of contaminant removal tape. This apparatus comprises: a turret assembly including a first winding cylinder and a second winding cylinder, where the first winding cylinder includes a first end, a second end opposite the first end, a cylinder wall, and a plurality of holes in the cylinder wall, where the first end of the second winding cylinder is attached to the turret assembly, where the second winding cylinder includes a first end, a second end opposite-the first end, a cylinder wall, and a plurality of holes in the cylinder wall, where the first end of the second winding cylinder is attached to the turret assembly; a first vacuum source providing vacuum to the first end of the first winding cylinder and to the plurality of the holes; a web breaking assembly moveable between a first web breaking assembly position and a second web breaking assembly position, where the web breaking assembly includes a blade, where the blade is moveable between a first blade position and a second blade position; a second vacuum source for providing vacuum to the second end of the first winding cylinder and to the plurality of holes; a support arm assembly, where the support arm assembly includes an extension member for engaging with the second end of the second winding cylinder, where the extension member is movable between a first position distant from the second end of the second winding cylinder and a second position to engage with the second end of the second winding cylinder to provide vacuum to the second end of the second winding cylinder and to provide mechanical support to the second end of the second winding cylinder; and a web guide movable between a first web guide position and a second web guide position, where the first web guide position is away from the winding cylinder path and the second web guide position is in the winding cylinder path, where the web guide is attached to the web breaking assembly, and where the web guide and the web breaking assembly are moveable together between the first position and the second position.

The present invention also provides a method of forming a roll of contaminant removal tape. This method comprises: a) winding a length of contaminant removal tape into a first roll about a first cylinder, where the first cylinder is movable between a first position and a second position along a cylinder path; b) providing a web breaking assembly linearly movable between a first position and a second position along a web breaking assembly path, where the web breaking assembly includes a blade linearly movable between a first blade position and a second blade position along blade path, where the first blade position is distant from the web and the second blade position is to break the web into a first length and a second length; c) moving the web breaking assembly from the first position in the cylinder path to the second position distant from the cylinder path; d) moving the first cylinder from the first position to the second position along the cylinder path; e) moving the web breaking assembly from the second position distant from the cylinder path to the first position in the cylinder path; f) providing a second cylinder, where the second cylinder is moveable between a first position and a second position along the cylinder path.

In one preferred embodiment of the above method, the method further comprises the steps of: g) contacting the length of tape about the second cylinder; and h) linearly moving the blade from the first blade position to a second blade position to break the web into a first length and a second length. One aspect of the above embodiment, the method, further comprises the steps of: i) winding the second length of tape into a second roll about the second cylinder; and j) removing the first roll of tape from the first cylinder. Another aspect of the above embodiment, steps (a)–(j) are repeated. In one preferred embodiment of the above, the length of contaminant removal tape includes a first side and second side opposite the first side, where the second side includes a layer of adhesive, and where step a) comprises winding the length of tape such that the layer of adhesive faces outwardly from the roll.

The present invention also provides an alternative method of forming a roll of contaminant removal tape. This method comprises: a) winding a length of contaminant removal tape into a first roll about a first cylinder, where the first cylinder includes a first end, a second end opposite the first end, a cylinder wall and a plurality of holes in the cylinder wall; b) providing a vacuum to the first end of the first cylinder and to the plurality of the holes; c) moving a support arm assembly from a first position distant from the second end of the first cylinder to a second position to engage with the second end of the first cylinder to support the second end of the first cylinder; d) thereafter breaking the length of tape with a web breaking assembly; and e) moving the support arm assembly from the second position to the first position.

In one preferred embodiment of the above method, the method comprises the step prior to step c) of: moving the first cylinder from a first position to a second position along a cylinder path and contacting the length of tape about a second cylinder. In another preferred embodiment of the above method, the method comprises the step prior to step d) of: providing a vacuum to the first end and second end of the first cylinder and to the plurality of holes. In another preferred embodiment of the above method, the length of tape includes a first side and second side opposite the first side, where the second side includes a layer of adhesive, and where step a) comprises winding the length of tape such that the layer of adhesive faces outwardly from the roll.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE INVENTION

Figure 1:
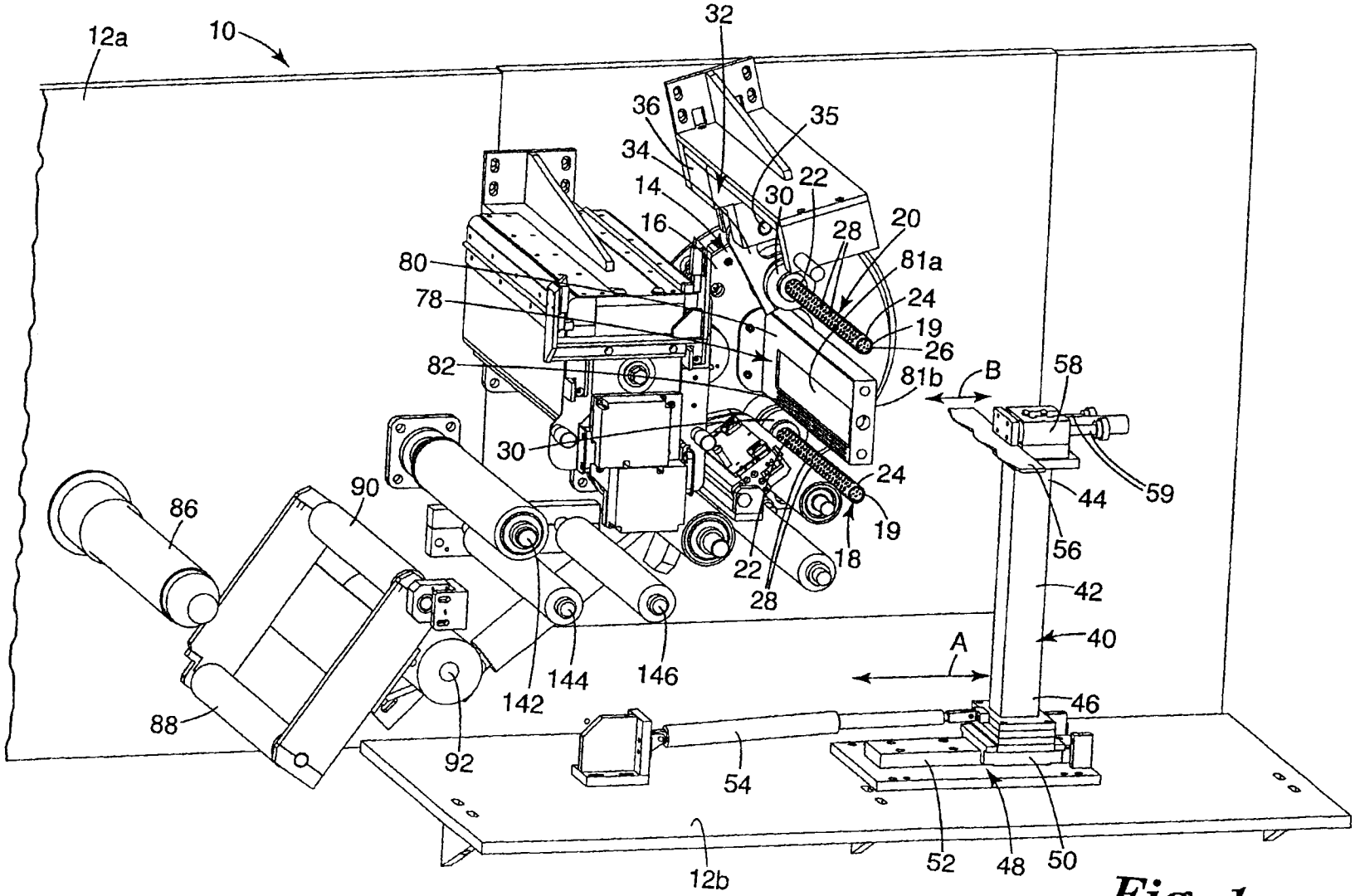
FIG. 1 is a perspective view of an apparatus for forming a roll of contaminant removal tape of the present invention with the support arm assembly removed for clarity.

The present invention provides an apparatus for forming a roll of contaminant removal tape. A roll of contaminant removal tape or lint removal tape is designed to pick up contaminants, such as lint, hair, threads, dirt or any other matter from a surface, such as floors, ceilings, work surfaces, or clothing, to clean the surface. The roll of contaminant removal tape is wrapped such that the layer of adhesive is facing outwards, away from the center of the roll, to allow it to remove contaminants from the surface.

The apparatus of the present invention is particularly useful for making coreless rolls of contaminant removal tape for "mini-lint rollers," which are smaller in size to allow a user to carry one in their purse or pocket. The rolls of removal tape on the mini lint rollers typically have significantly smaller inner and outer diameters in comparison to the rolls of removal tape on the "regular-sized lint rollers," which for example are currently commercially available under the 3M brand from 3M Company based in St. Paul, Minn. For example, the typical regular-sized lint roller has a roll of removal tape with an inner diameter of 1.76 inches (4.47 cm), and an outer diameter in the range of 1.8 inches (4.57 cm) to 2.5 inches (6.35 cm). In comparison, the mini-lint roller has a roll of removal tape preferably with an inner diameter of 0.89 inches (2.26 cm), and an outer diameter of 1.1 inches (2.79 cm). The overall length of the rolls of removal tape is also different, when comparing the roll of the regular-sized lint rollers with the roll of a mini-linter roller. For example, the roll on a regular-sized lint roller has a length of four inches (10.16 cm), where the roll on a mini-lint roller has width of three inches (7.62 cm). Because the inner and outer diameters of the tape rolls on the mini-lint rollers are so small, for example approximately 1 inch, this presents certain difficulties in manufacturing such rolls. The apparatus of the present invention includes several different aspects and embodiments which independently and/or together assist in making rolls for mini-lint rollers, which is explained in more detail below. Alternatively, the apparatus 10 may be used to manufacture regular-sized lint rollers.

FIG. 1 illustrates one embodiment of the apparatus 10 for forming a roll of contaminant removal tape of the present invention. This figure is convenient for describing the various assemblies that make up the apparatus 10. The apparatus 10 includes a support arm assembly 60, which has been removed in FIGS. 1–4 and 6–8 for clarity, but is described in reference to FIG. 5.

The apparatus includes a first plate 12*a* and a second plate 12*b*, which is preferably mounted perpendicular to the first plate 12*a*. The apparatus includes a turret assembly 14 attached to plate 12*a*. The turret assembly 14 includes a turret head 16 that rotates 360° in a plane parallel to the first plate 12*a*. The turret assembly 14 includes a motor (not shown) for rotating the turret head 16. The turret assembly 14 further includes two winding stations for winding rolls of contaminant removal tape, as explained in more detail below. The first winding station includes a first winding cylinder 18 or a winding mandrel 18. The second winding station includes a second winding cylinder 20 or a second winding mandrel 20. Both winding cylinders 18, 20 include a first end 22 and a second end 24 opposite the first end 22. The first end 22 of the winding cylinders 18, 20 is mounted perpendicular to the turret head 16. When the turret assembly 14 rotates, the winding cylinders rotate with it because they are attached to the turret assembly 14. Preferably, the winding cylinders 18, 20 are hollow and include a plurality of holes 28 through the winding cylinder wall 19 for providing vacuum to the roll of contaminant removal tape, as the web is being wrapped around the cylinder. The holes 28 in the winding cylinders 18, 20 are in fluid communication with the first end 22 and the second end 24 of the cylinders 18, 20 to allow a vacuum to be pulled through the holes 28. Preferably, the cylinder wall 19 includes a first surface and a second surface opposite the first surface, where the second surface faces outwardly from the winding cylinder 18, 20. More preferably, the holes 28 in the winding cylinders 18, 20 have a first diameter in the first surface and a second diameter in the second surface, where the second diameter is greater than the first diameter. In other words, the diameter of the holes 28 expands from the inside of the winding cylinder to the outside of the winding cylinder. This hole configuration assists in increasing the area of the vacuum without significantly increasing the flow of the vacuum. Both winding cylinders 18, 20 rotate independently about their respective axis. Each winding cylinder 18, 20 has a motor (not shown) for rotating the cylinders. Alternatively, the winding cylinders 18, 20 may be driven by a single motor. The apparatus also includes a vacuum source (not shown), such as a vacuum pump, for providing vacuum to the first end of the winding cylinders 18, 20. The vacuum pump may be a part of the turret assembly. However, this is not required.

The turret assembly 14 includes a vacuum assembly 78. The vacuum assembly 78 includes a vacuum box 80 mounted to the turret head 16. The vacuum box 80 includes a vacuum source (not shown), such as a vacuum pump. The vacuum box 80 includes a first side 81*a* and a second side 81*b*. Both sides 81*a*, 81*b* have a plurality of channels 82 for providing a vacuum for the web of tape between the first and second winding cylinders 18, 20, as explained in more detail below. When the turret assembly 14 rotates, the vacuum assembly 78 rotates with it because it is mounted to the turret heat 16.

Figure 2:
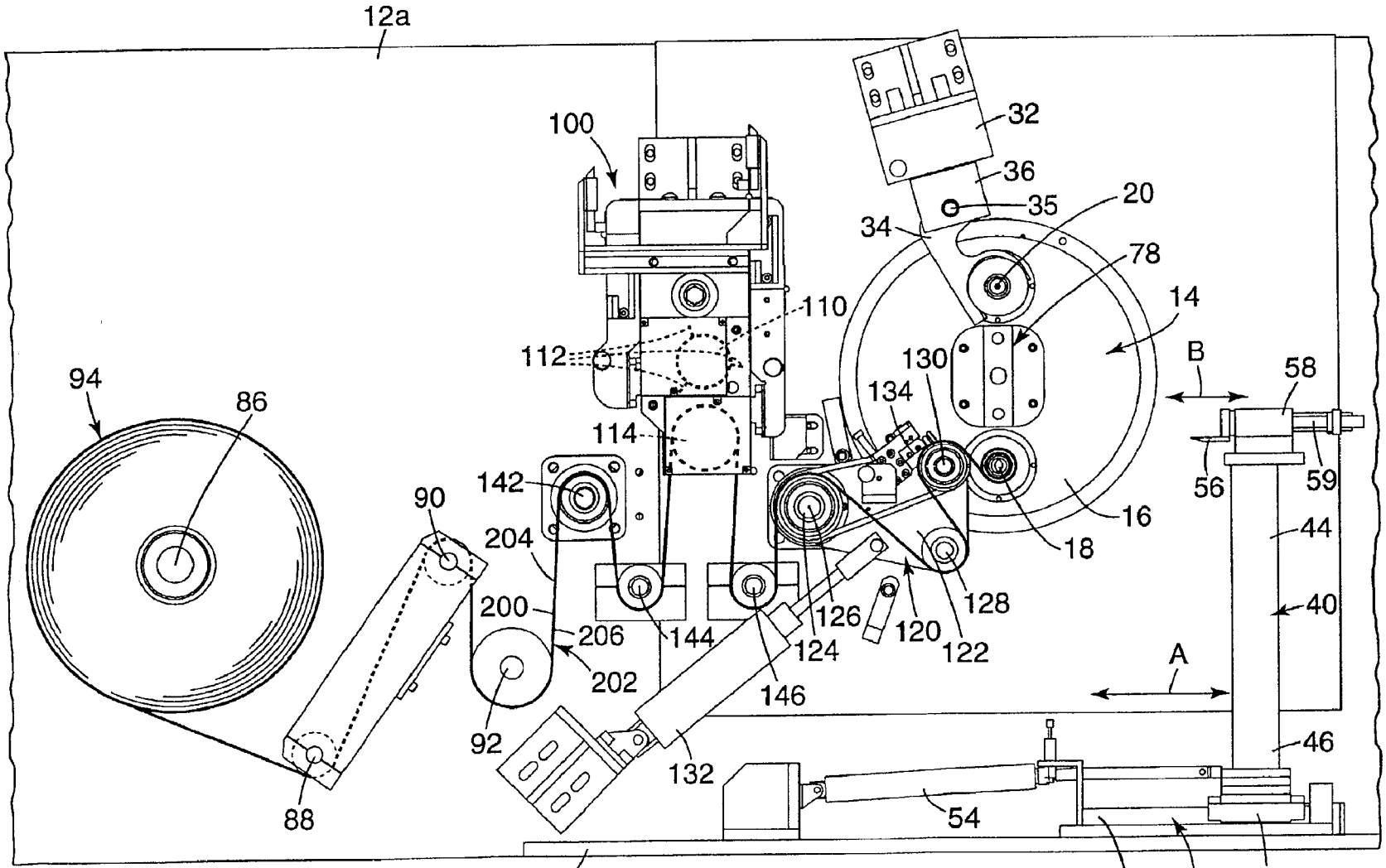
FIG. 2 is a side view of the apparatus of FIG. 1 illustrating a tape path through the apparatus and illustrating winding contaminant removal tape around the first winding cylinder.
Figure 3:
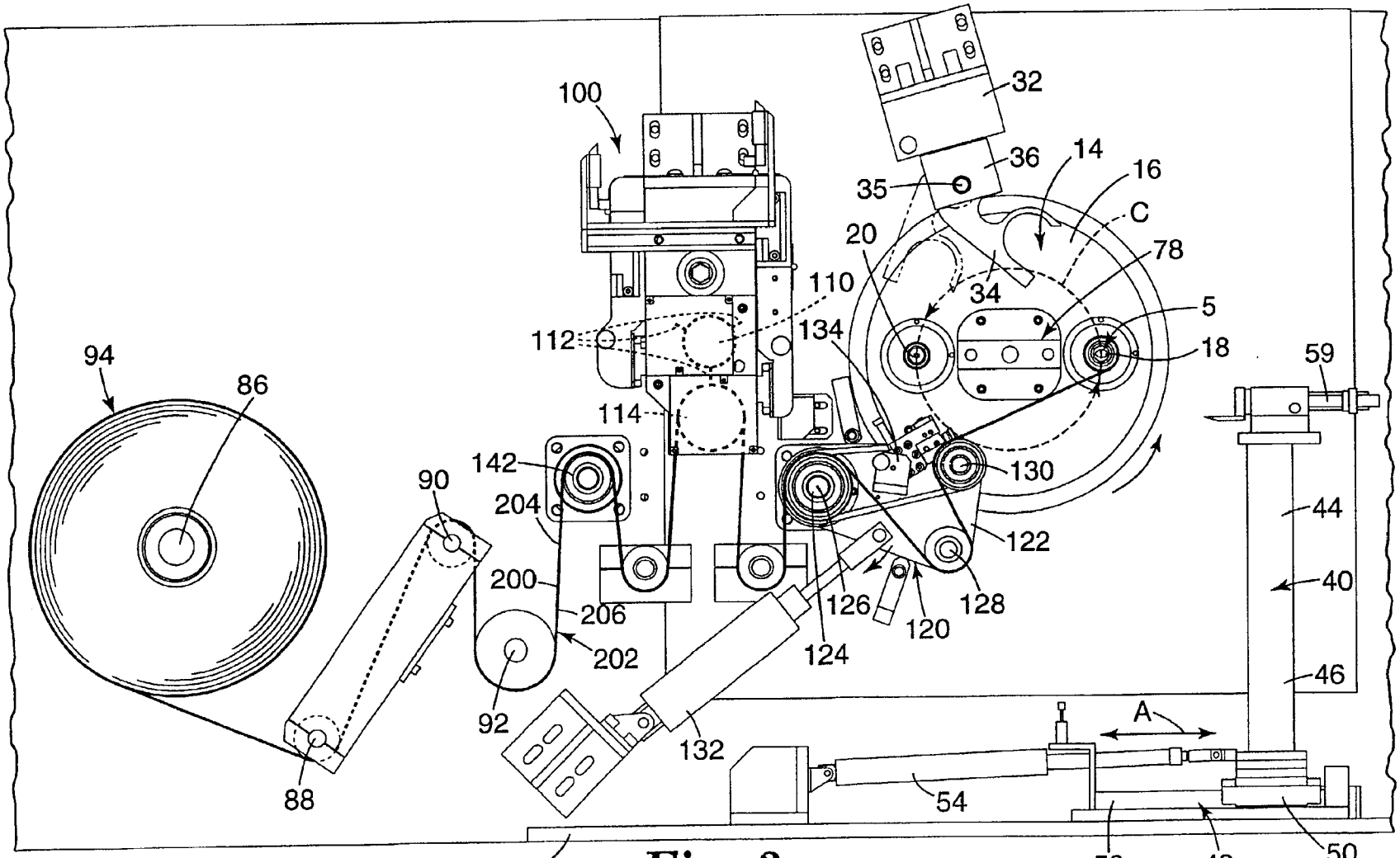
FIG. 3 is a side view of the apparatus of FIG. 2 illustrating the apparatus as the turret assembly rotates.
Figure 4:
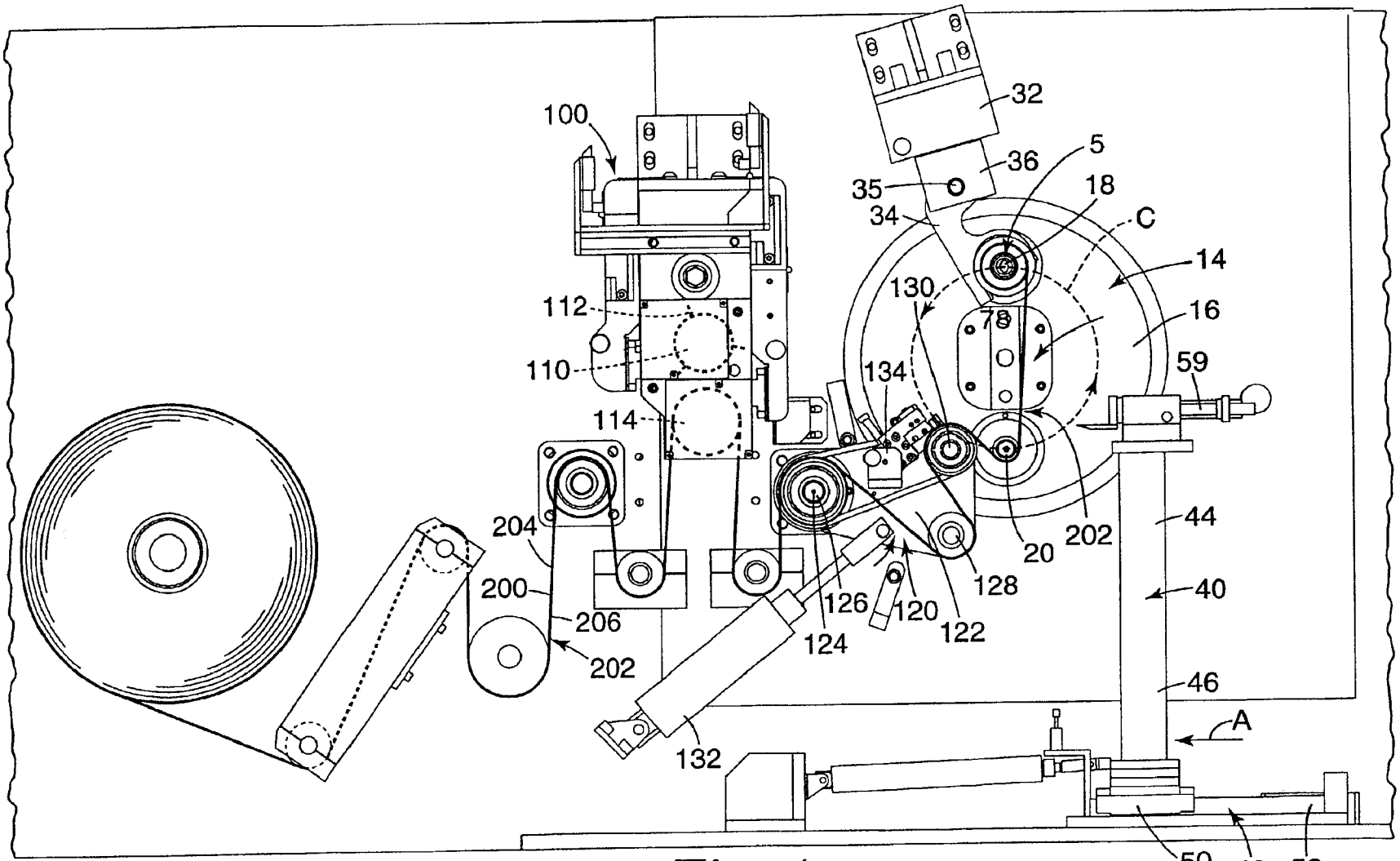
FIG. 4 is a side view of the apparatus of FIG. 3 after the turret assembly has rotated 180° to place the second winding cylinder in contact with the web.

The apparatus 10 includes a web breaking assembly 40 mounted to the second plate 12*b*. The web breaking assembly breaks the web of removal material, as explained in more detail below. The web breaking assembly 40 includes an arm 42 that has a first end 44 and a second end 46 opposite the first end 44. The second end 46 of the arm 42 is mounted to a slide 50. Slide 50 moves relative to rail 52 to allow the web breaking assembly to move between a first position, as illustrated in FIGS. 1–3, and a second position, as illustrated in FIG. 4, along a web breaking assembly path designated by arrow A. The web breaking assembly is moved between the first position and the second position by first actuator 54. Preferably, the web breaking assembly 40 moves in a linear direction between a first position and a second position. A suitable first actuator 54 is commercially available as an air cylinder under the brand name Bimba available from John Henry Foster based in St. Louis Mo., as part number MRS-096-DXP. The slide 50 and rail 52 together make up a linear bearing 48. A suitable slide 50 and rail 52 are commercially available as a linear bearing guide block/slide and rail from McMaster Carr based in Elmhurst, Ill., as part numbers 6382K51 and 6382K26. A blade 56 is mounted on the fist end 44 of the arm 42. Preferably, the blade 56 has a sinusoidal-shaped or wave-shaped surface proximate the web 202, which is useful for breaking the perforated web, as explained in more detail below. However, the blade 56 may include any shaped edge. When the term "blade" is used herein, including the claims, it shall mean any device capable of breaking the web into two separate pieces, even if the blade does not have a sharp edge for cutting the web, but rather has a flat, dull surface for applying a force along a perforated or scored line in the web to separate the web into two pieces. The blade 56 is moveable between a first position, illustrated in FIGS. 1–2 and a second position, illustrated in FIG. 6, along a blade path designated by arrow B. The second actuator 58, guided by rods 59, moves the blade 56. One suitable actuator is an air cylinder using a solenoid available under the brand name Mead Nova from McMaster Carr based in Elmhurst, Ill. as part number 1 N2-SCD and a linear slid assembly under the brand name Bimba from John Henry Foster based in St. Louis, Mo. as part number TE-041.5-EB2M.

The apparatus includes a roll ejector assembly 32 mounted to the plate 12*a* above the turret assembly 14. The roll ejector assembly 32 will assist in removing the rolls of contaminant removal tape from the winding cylinders 18, 20, as explained in more detail in the discussion related to FIG. 7. The roll ejector assembly 32 includes an ejector arm 34 that pivots about pivot 35 and contacts a disk 30. Each of the winding cylinders 18, 20 includes a disk 30 that is slideably engaged with its respective cylinder 18, 20. The ejector arm 34 includes a hook on one end that mates with the section of the winding cylinders 18, 20 between the turret head 16 and the disk 30. The ejector arm 34 also includes a spring to keep it biased in the position illustrated in FIG. 1. The roll ejector assembly 32 includes a rod-less air cylinder 36 for pivoting the ejector arm 34 about its pivot. One example of a suitable rod-less air cylinder is commercially available under brand name Bimba from John Henry Foster based in St. Louis Mo.

The apparatus 10 includes a series of driven and idle rollers for providing a web of contaminant removal material to the turret assembly 14. All the rollers are attached to the first plate 12*a*. The first roller 86 is for receiving a large roll 94 of contaminant removal material. The apparatus also includes a second roller 88, third roller 90, a fourth roller 92, a fifth roller 142, a sixth roller 144, and a seventh roller 146. The third roller 90 is a driven roller. A motor (not shown) rotates the driven roller 90 and the driven roller 90 pulls the web 202 from the roll 94 of contaminant removal material.

FIG. 2 is convenient for describing the web perforation assembly 100, the roller assembly 120, the web slitter 134, and the web path through the apparatus 10.

Preferably, the apparatus 10 includes web perforation assembly 100. The web perforation assembly 100 cuts the web in the transverse direction with a serrated blade 112 to form perforations in the web. The perforation is a series of holes or slits in the web, preferably along a straight line.

Alternatively, the web perforation assembly 100 may form a breaking line in the web 202, such as forming a scored or partially scored line in the web 202, where the web 202 is cut partially through the thickness of the web 202, but the web, 202 remains in tact until it is broken into two separate pieces by the web breaking assembly 40. The web perforation assembly 100 includes a driven roller 110 and a driven roller 114. The roller 110 includes a plurality of serrated blades 112 located equidistant around the roller 110. Roller 110 is illustrated as including three serrated blades 112. However, roller 110 may include any number of blades 112 or only one blade 112. The web 202 of contaminant removal material travels between roller 110 and roller 114. When a perforation line in the web is desired, the roller 110 rotates to bring one of the serrated blades 112 into contact with the web 202 traveling around the roller 114. The roller 114 provides a back support for the serrated blade 112 as it cuts through the web. Preferably, the roller 110 and 114 travel at the same speed when the perforation line is formed, so as to not rip or stretch the web 202 as to travels between the two rollers 110, 114.

The apparatus 10 includes a controller (not shown), which sends signals to all of the driven rollers, assemblies, and actuators in the apparatus. An example of a suitable controller is commercially available under the brand name Allen Bradley from Northland Electric Company based in St. Paul, Minn. As an example, the controller sends a signal to roller 110 when to rotate based on the desired distance between adjacent lines of perforation in the web. The perforations in the web 202 of the contaminant removal material may be equidistant from each other along the web. Alternatively, the perforations in the web 202 may be spaced such that the sections of the web between adjacent perforations may be increasing or decreasing in length. Preferably, the perforations in the web 202 are spaced such that the length of the sections of web between the perforations is increasing to provide a roll of lint removal tape as described in U.S. Pat. No. 5,763,038 (Wood), "Progressively Perforated Tape Roll," described in the Background section.

The apparatus 10 includes a roller assembly 120 attached to the first plate 12*a*. The roller assembly 120 transports the web 202 from the seventh roller 146 to the winding cylinders 18, 20. The roller assembly 120 includes a triangle-shaped plate 122 that pivots about pivot 126. The roller assembly 120 also includes a first drive roller 124, an idler roller 128, and a second drive roller 130. A motor (not shown) rotates the first and second drive rollers 124, 130. Preferably, the roller assembly 120 includes a web slitter 134, which includes a plurality of blades for cutting the web in the longitudinal direction just prior to wrapping the web 202 around the winding cylinders 18, 20. By cutting or slitting the web longitudinally into a plurality of lengths of web 202, it is possible to form a plurality of rolls around the winding cylinders 18, 20 at the same time.

FIG. 2 illustrates a side view of the apparatus including a web 202 of contaminant removal material moving through the apparatus 10. The web 202 of contaminant removal material includes a backing 204 and a layer of adhesive 206 on one side of the backing 14. The winding cylinders 18, 20, rotate to form a plurality of wraps of the contaminant removal web 202 about the center axis of the winding cylinder to form a roll 5 of contaminant removal tape 208. The layer of adhesive 206 of the web 202 faces outwards, away from the center of the roll 5. The non-adhesive side of the backing 204 of the web 202 faces inwards, towards the center of the roll 5.

The web 202 of contaminant removal material moves along the following web path 200 within apparatus 10: a) from the first roller 86 to the second roller 88; b) then to the third roller 90; c) then to the fourth roller 92; d) then to the fifth roller 142; e) then to the sixth roller 144; f) then between roller 110 and roller 114 of the web perforation assembly 100; g) then to the seventh roller 146; h) then to the first driver roller 124 and the idler roller 128 of the roller assembly 120; i) then between the web slitter 134 and the drive roller 130 of the roller assembly 120, where the web is cut into a plurality of lengths of web and j) then around the first winding cylinder 18. While the apparatus 10 operates, the web 202 may move in, the range of 40 feet/minute to 150 feet/minute, when making rolls for mini-lint rollers. The web 202 may move in the range of 100 feet/minute to 350 feet/minute, when making rolls for regular sized lint rollers.

FIG. 2 illustrates initial start position of the apparatus 10. In this position, the web 202 of contaminant removal material is being wound around first winding cylinder 18, as the cylinder rotates counter clockwise. Preferably, the web 202 is wound around the cylinder with the adhesive side 206 facing outwards from the cylinder. While the first winding cylinder is rotating, a first vacuum source (not shown) is providing vacuum to the turret head 16, which is in fluid communication with the first end 22 of the first winding cylinder 18, which is ultimately providing vacuum to the holes 28. As the vacuum source continues to pull air from the first end of the first winding cylinder 22, the holes 28 in the first winding cylinder 18 provide a vacuum to the backing side 204 of the contaminant removal material. It is preferred to provide vacuum to the winding cylinders to assist in keeping the backing side 204 of the web 202 of the first wrap around the cylinder 18 tightly adhered to the cylinder 18. As the winding cylinder 18 continues to rotate, the backing side 204 of the web 20 of an outer wrap will adhere to the adhesive side 206 on an inner wrap, to-provide a tightly wound tape roll 5. The first winding cylinder 18 will continue to rotate until it accumulates a desired number of wraps around the cylinder to form a desired roll of contaminant removal tape. Because the web slitter 134 converts the wide web of contaminant removal material to several lengths of contaminant removal material, the winding cylinder 18 may form several rolls at once about its axis. However, the web slitter 134 is not necessary and the apparatus may instead form one long roll 5 of contaminant removal tape.

While first winding cylinder 18 is winding tape about its axis, the ejector arm 34 of the roll ejector assembly 32 is biased by a spring to hold the first end 22 of the second winding cylinder 20. The web breaking assembly 40 is stationary in its first position. The blade 56 is also stationary in its first position. Also during this time, the controller sends to periodic signals to the web perforation assembly 100 to form perforations in the web 202 with the serrated blades 112 of the roller 110.

While the web 202 is being wrapped around the first cylinder 18, the web breaking assembly is in its first position, which is outside the path C that the cylinders 18, 20 follow when the turret assembly 14 rotates. Once a predetermined number of wraps are around the first cylinder 18, the controller sends a signal to the fourth actuator 132 to pivot the roller assembly 120 clockwise toward the plate 12*b*, to move it out of the cylinder path into a second position, as illustrated in FIG. 3. Next, the controller sends a signal to the motor that rotates the turret assembly 14. The turret assembly 14 rotates counter clockwise for approximately 180°. This is to place the first winding cylinder 18 in the same position that was previously occupied by the second winding cylinder 20 and the second winding cylinder 20 in the same position that was previously occupied by the first winding cylinder 18 (as illustrated in FIG. 4). As the turret assembly 14 rotates, the first winding cylinder 18 continues to rotate about its axis and wind web around the cylinder. As the turret assembly 14 rotates, the winding cylinders 18, 20 follow a winding cylinder path designated by dotted line C. As the second winding cylinder 20 moves along this path, the ejector arm 34 pivots clockwise about pivot 35, as shown in phantom lines. After the second winding cylinder 20 has moved far enough along the path C to no longer contact the ejector arm 34, the spring (not shown) pulls the ejector arm back to its original position (shown in solid lines) ready to receive the first winding cylinder 18 carrying the rolls 5 of contaminant removal tape.

FIG. 4 illustrates the apparatus 10 after the turret assembly 14 has rotated 180°. The first winding cylinder 18 in now in the same position that was previously occupied by the second winding cylinder 20 and the second winding cylinder 20 is now in the same position that was previously occupied by the first winding cylinder 18. In this position, the web 202 is wrapped approximately halfway around the second winding cylinder 20 or contacts the second winding cylinder 20. The portion of the web 202 extending between the first winding cylinder 18 and the second winding cylinder 20 is being pulled by a vacuum source inside vacuum assembly 78 through channels 82. The vacuum assembly 78 helps keep the web 202 straight as the web is moving between the second winding cylinder 20 to the first winding cylinder. After the turret assembly 14 stops rotating, the controller sends a signal to the first actuator 54 to move the web breaking assembly 40 from the first position to the second position in the direction of A. At about the same time, the controller also sends a signal to the fourth actuator 132 to pivot the roller assembly 120 counterclockwise toward the turret assembly 14. In this position, the first winding cylinder 18 continues to rotate about its axis, winding the web around the cylinder.

Figure 5:
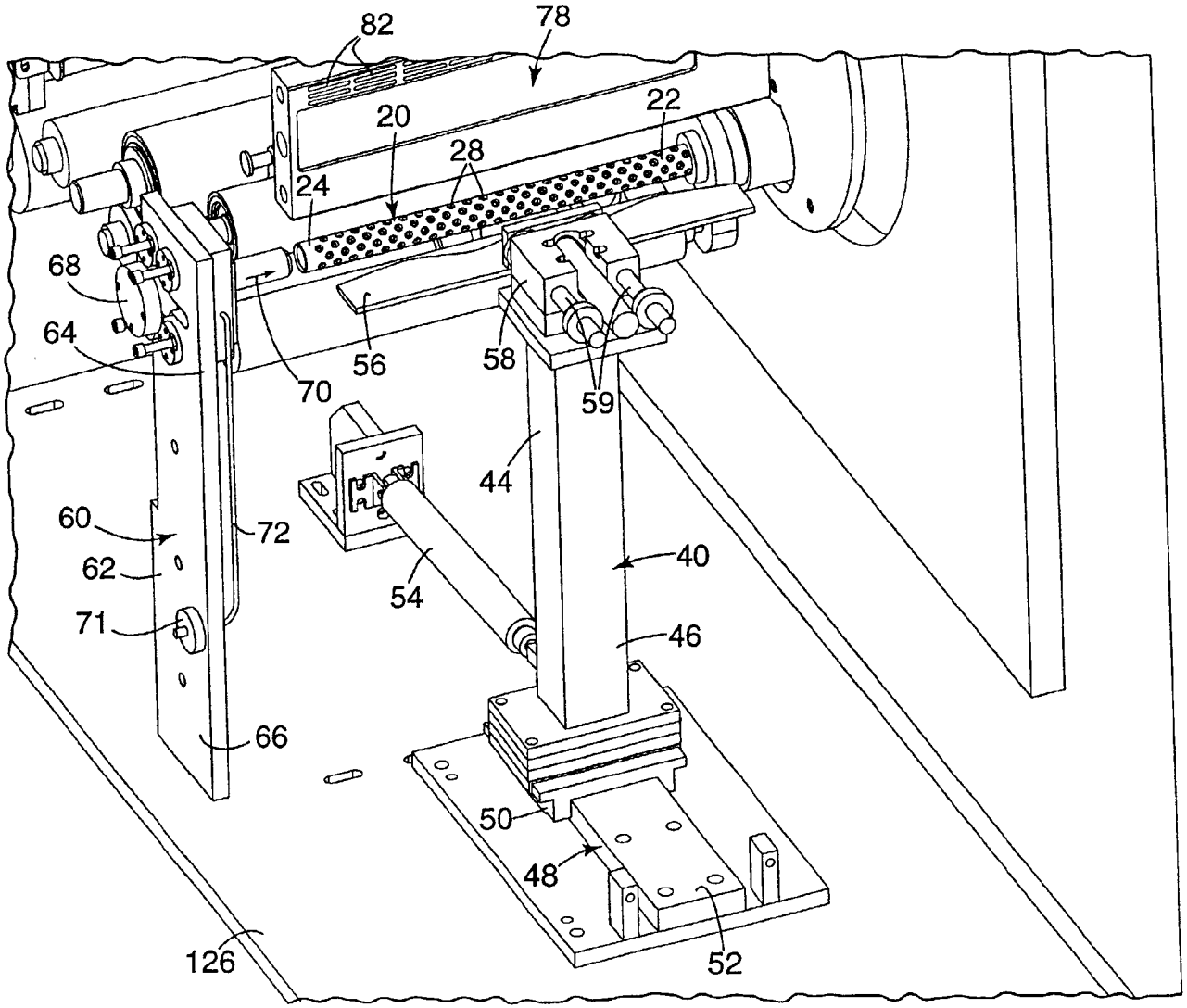
FIG. 5 is a perspective view of the support arm assembly and the web breaking assembly.
Figure 6:
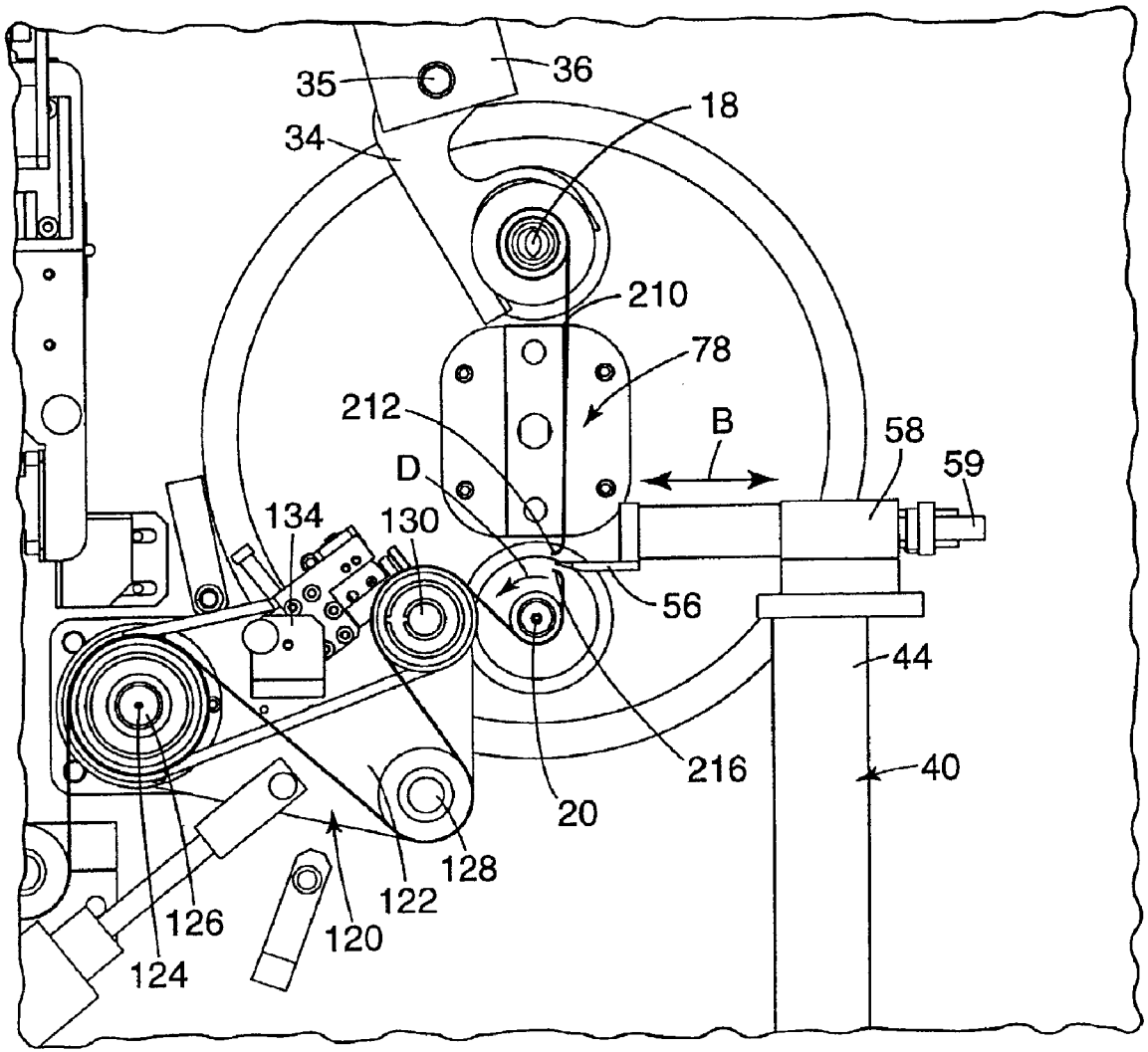
FIG. 6 is an enlarged side view of the apparatus of FIG. 4 illustrating the web breaking assembly breaking the web.

FIG. 5 illustrates the support arm assembly 60 of the apparatus 10, which was not illustrated in FIGS. 1–4 for ease in describing the other components of the apparatus 10. The support arm assembly 60 includes a support arm 62, which has a first end 64 and a second end 66 opposite the first end. The second end 66 is mounted to the plate 12*b*. The first end 64 of the support arm 62 includes an extension member 70, which moves in a direction perpendicular to the length of the support arm 62. A third actuator 68, such as an air cylinder, moves the extension member 70 to engage and disengage with the second end 24 of the second winding cylinder 20. The support arm assembly 60 includes a vacuum source 71, which is in fluid communication with the extension member 70. When the extension member 70 is connected to the second end 24 of the winding cylinder, the vacuum source 71 provides vacuum through the extension member 70, into the winding cylinder and through the holes 28.

The support arm assembly 60 serves two independent purposes. The first purpose of the support arm assembly 60 is to provide mechanical support to the second end 24 of the winding cylinder 18, 20, while the web breaking mechanism 40 breaks or separates the web into two separate sections. When the extension member 70 is properly mated with the second end 24 of the first winding cylinder, the winding cylinder 18 is then mechanically supported on both ends 22, 24. The second purpose is to provide another vacuum source to the winding cylinders 18, 20. The second end 24 of the winding cylinders 18, 20 and the free end of the extension member 70 are chamfered to mate together tightly, such that the vacuum is provided into the winding cylinder without loosing much of the vacuum. The controller sends a signal to the third actuator 68 to move the extension member from a first position to a second position to engage with the second end of the winding cylinder just before the web breaking assembly moves from its first position to its second position to break the web.

The support arm assembly 60 is particularly useful in the apparatus for making rolls of contaminant removal tape for mini-lint rollers, which typically have inner diameters of approximately 0.89 inches (2.26 cm) and outer diameters of approximately inches. Because the inner diameters of the rolls are typically less than one inch, the winding cylinders are also less than one inch in diameter. If the winding cylinders 18, 20 are not mechanically supported at both ends 22,24, then the winding cylinders have a tendency to start to oscillate about the end 22 that is fixed to the turret head 16 after the web breaking assembly 40 breaks the web. If the winding cylinders were to oscillate as they rotate, it is possible that the web might have wrinkles or be crooked as it is wound around the cylinder. By providing mechanical support at both ends 22, 24 of the cylinder, the second length 214 of the web 202 may contact the cylinder without causing the cylinder to move. Additionally, the support arm assembly 60 includes an additional vacuum source to provide vacuum into the winding cylinders and through the holes 28. This additional vacuum source, in combination with the vacuum source on the turret assembly 14, increases the chances that the second length 214 will be drawn to the winding cylinder to start winding the web around the winding cylinder.

After the third actuator 68 moves the extension member 70 of the support arm assembly to mate with the second end 24 of the first winding cylinder 18 to provide both mechanical support and to provide an additional vacuum source to the winding cylinder, the blade 56 of-the web breaking apparatus moves from a first position to a second position along the direction of the arrow B (shown in FIG. 6) to break the web 202. Preferably, the blade 56 moves in a linear direction between a first position and a second position. By moving in a linear direction, or in a straight line between the first position and second position, the blade can hit a breaking line in the moving web 202 accurately, for example within a range of 0.125 inches (0.32 cm) from a breaking line. The position of a desired perforation or breaking line in the moving web 202 can be determined by knowing the web speed and the web path distance between the web perforation assembly 100 and the area where the blade 56 strikes the moving web between the winding cylinder and vacuum assembly 78. If the position of the desired breaking line is known, the controller can send an appropriate signal to the blade to strike the perforation or breaking line as it moves past the blade. The blade 56 moves from a first position, away from the web, to a second position to break the web into a first length 210 and a second length 214. While moving in the linear direction, the blade may move at speeds in the range of 100 inches/second to 500 inches/second. It is preferable to move the blade 56 in a linear direction to break the web, as opposed to moving the blade in a radial direction, because it minimizes the problem of the second length 214 wrapping around the blade. In this preferred configuration, the second length 214 is limited in movement because the blade extends far past the second winding cylinder 20 and thus, restricts its movement to between the blade and the second winding cylinder 20. After the blade strikes the web, the second length 214 falls in the direction toward the second cylinder 20.

When the term "breaking" is used herein, including the claims, it shall mean any method of separating the web into two sections or pieces, such as cutting a continuous web or by applying a force along a previously weakened, prepared, scored or perforation line to separate the sections on either side of the scored or perforation line. The sinusoidal-shaped surface of the blade 56 is arranged such that the crests of the surface approximately contact the middle of the perforation line in each of individual portions of the web 202. Once the crest of the blade surface breaks through the middle of the perforation line, the rest of the perforation line then separates the web into two separate pieces.

After the web breaking assembly 40 breaks the web along a desired breaking or perforation line, it forms a first length 210 of web 202 with a trailing edge 212 and the second length 214 of web 202 with a leading edge 216. The first length 210 will continue to move upward past the vacuum assembly 78 and be wrapped around the first cylinder 18. The vacuum assembly 78 continues to provide resistance on the first length 210 of web 202, as it is traveling past the channels 82 in the vacuum box 80. The vacuum assembly 78 controls the travel of the free end of the first length 210 until it is finished wrapping around the first winding cylinder 18. Without the vacuum assembly providing resistance on the first length 210 of web 202, the first length 210 may snap upwards towards the first winding cylinder after the web breaking assembly 40 breaks the web into two lengths because the web 202 is under tension. Meanwhile, the leading edge 216 of the second length 214 will be pulled down, as indicated by arrow D, by the vacuum force coming through the holes in the winding cylinder to start wrapping around the second cylinder 20. Meanwhile, the second winding cylinder 20 is rotating counter clockwise, winding the second length of web 202 around the winding cylinder. The process described above with regard to the first winding cylinder 18 is then repeated with respect to the second winding cylinder 20 to form new rolls of contaminant removal tape about the second winding cylinder 20.

The web breaking assembly 40 and the support arm assembly 60 are designed to preferably work together, however both assemblies may work independently and the apparatus is not required to have both assemblies 40, 60.

Figure 7:
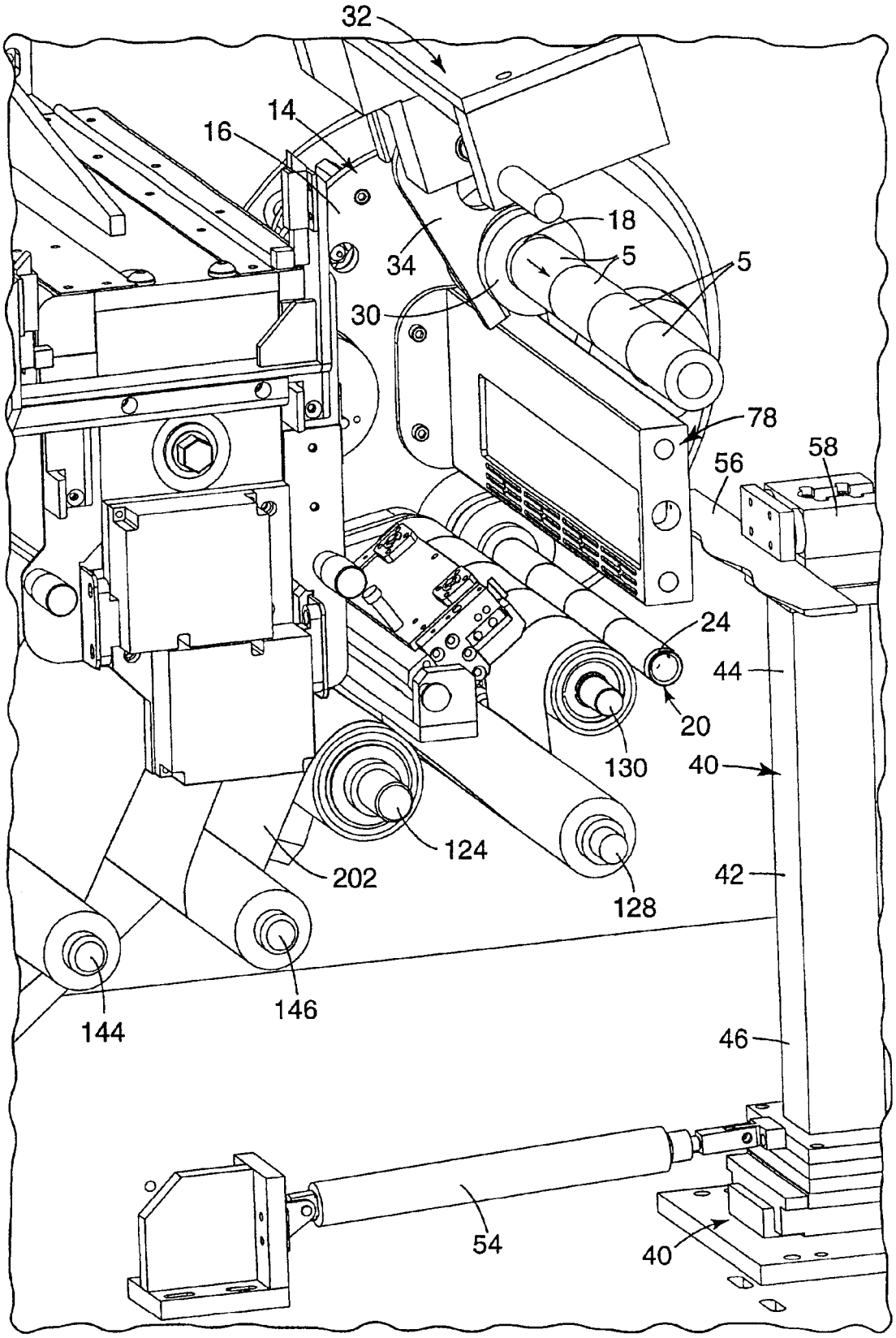
FIG. 7 is an enlarged perspective view of the apparatus of FIG. 6 illustrating the roll removal assembly removing rolls of contaminant removal tape from the first winding cylinder and illustrating winding contaminant removal tape around the second winding cylinder.

FIG. 7 illustrates the rolls 5 of contaminant removal material being pushed off the first winding cylinder 18. The ejector arm 34 is moved relative to the length of the first winding cylinder 18, contacting the disk 30, which in turns pushes the rolls 5 off the cylinder 18. Pressurized air may be blown out the first winding cylinder 18 through the holes 28 to help disengage the rolls 5 from the cylinder as the ejector arm 34 is moving them. During this time the vacuum source on the turret assembly 14 is off and the first winding cylinder 18 continues to rotate counter clockwise. Meanwhile, the web 202 is being wound around the second winding cylinder, forming a new set of rolls, similar to the way described in respect to first winding cylinder above. Once the desired number of wraps is around-the second cylinder 20, the turret assembly will rotate, to remove the rolls from the second cylinder, as described above. This process will continue to repeat as described above, with the apparatus 10 making rolls around the winding cylinders 18, 20 and rotating the turret assembly 14.

Figure 8:
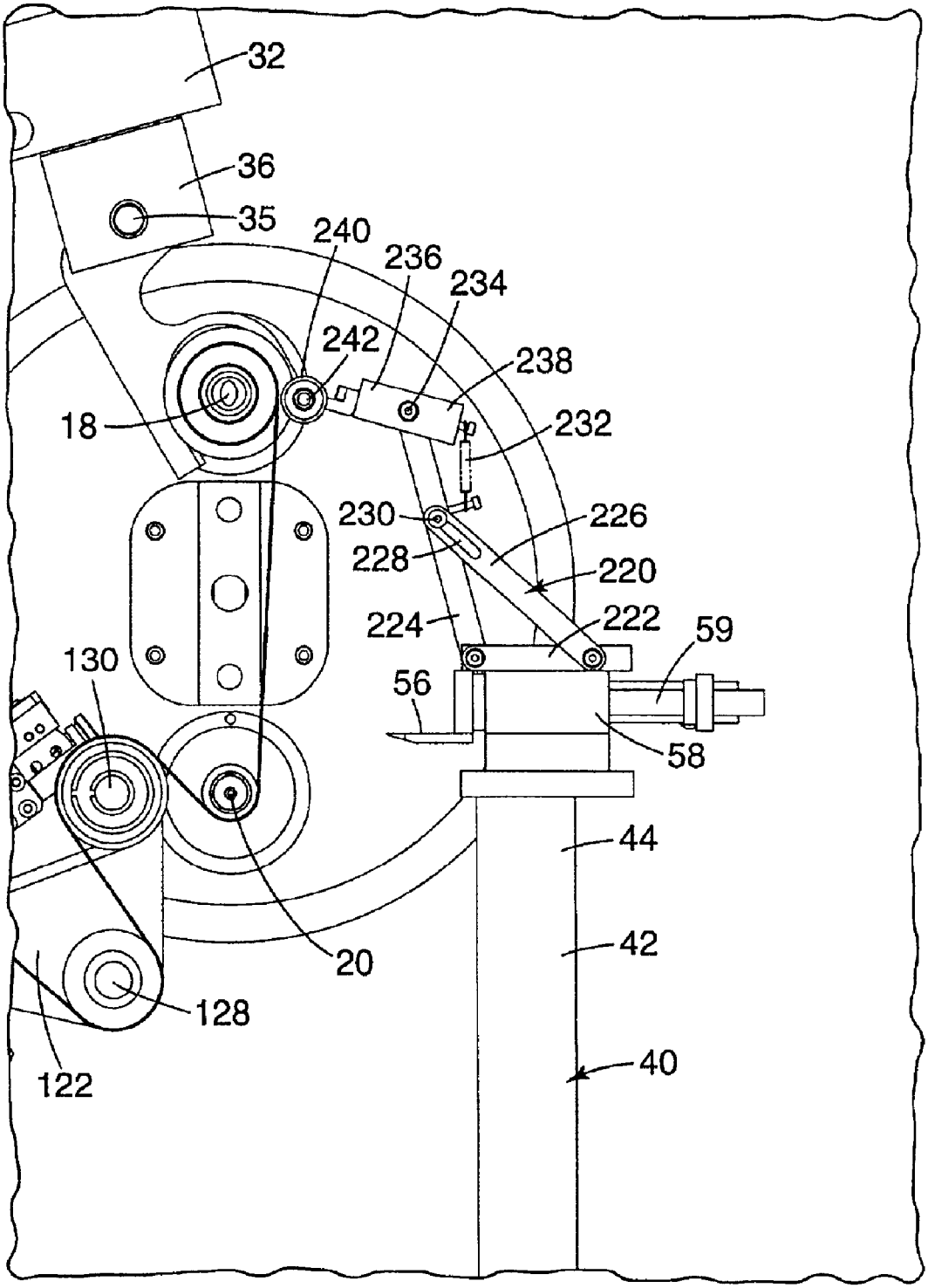
FIG. 8 is a side view of an alternative web breaking assembly including an optional web guide.

FIG. 8 illustrates an optional web guide assembly 220 on the apparatus 10. The web guide assembly 220 includes a base plate preferably mounted to the web breaking assembly 40. The web guide assembly 220 also includes a stand-off plate 224 attached to the base plate 222, which is held into position by linkage arm 226 though use of a bolt 230 and a slot 228 in the linkage arm 226. The web guide assembly 220 also includes an arm 236 mounted to the stand-off plate 224 opposite the base plate 222 by pivot 234. The arm 236 has a first end 238 and a second end 240. A spring 232 is attached to the first end 238 of the arm to keep it biased in the position illustrated in FIG. 8. A roller 242 is mounted to the second end 240 of the arm 236. The roller 242 preferably extends the length of the winding cylinder 18 to keep-the web 202 in contact with the winding cylinder 18. The web guide assembly 40 assists in keeping the web 202 straight as it is being wrapped around the winding cylinder 18. This helps avoid any wrinkles in the roll as the web is being wrapped around the cylinder. Preferably, the web guide assembly is set up such that when the web breaking assembly 40 is moved to the second position, the roller 242 presses the moving web 202 against the first winding cylinder 18. When the web breaking assembly moves back the first position, the web guide assembly 220 is out of the travel path of the winding cylinders when the turret assembly 14 rotates. Although the web guide assembly 220 is illustrated as attached to the web breaking assembly, the web guide assembly 220 could be a stand-alone assembly and then may move in sequence with the web breaking assembly from a first position out of the winding cylinder path to a second position in the winding cylinder path.

Figure 9:
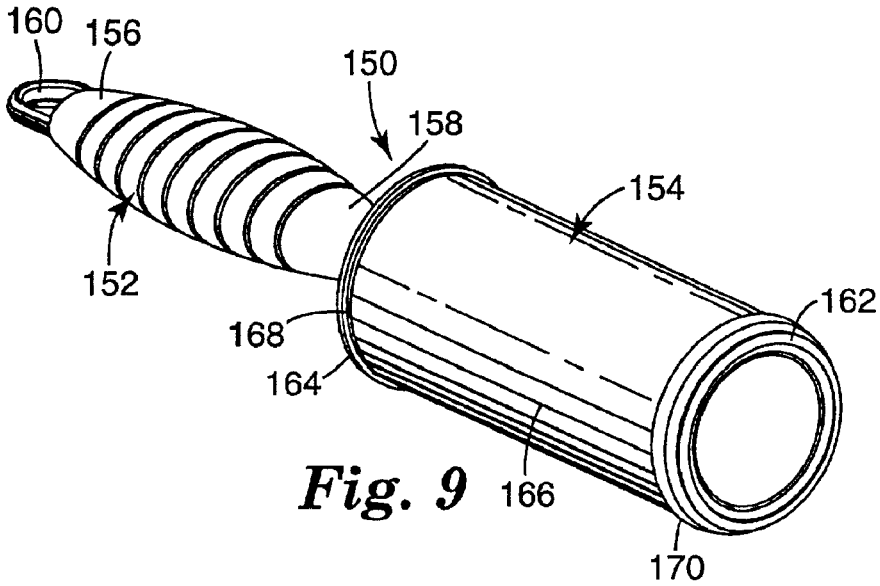
FIG. 9 is a perspective view of one embodiment of an applicator for use with a roll of contaminant removal tape made by the apparatus of FIG. 1.
Figure 10:
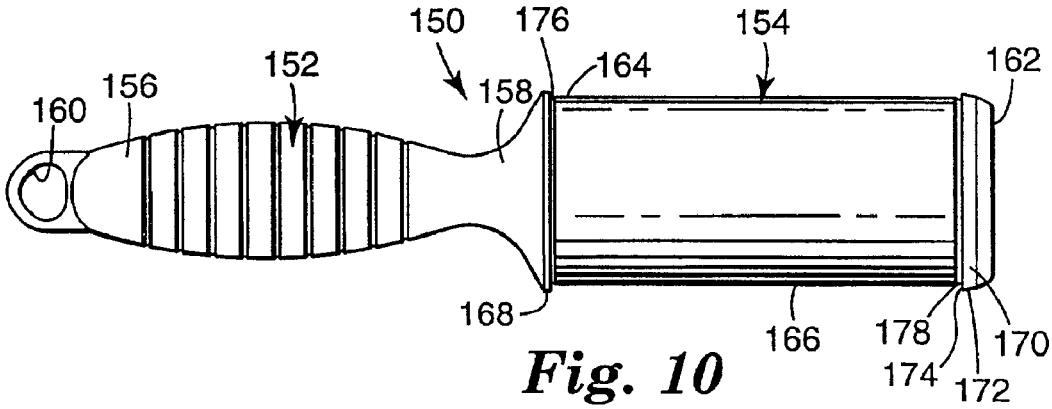
FIG. 10 is a side view of the applicator of FIG. 9.
Figure 11:
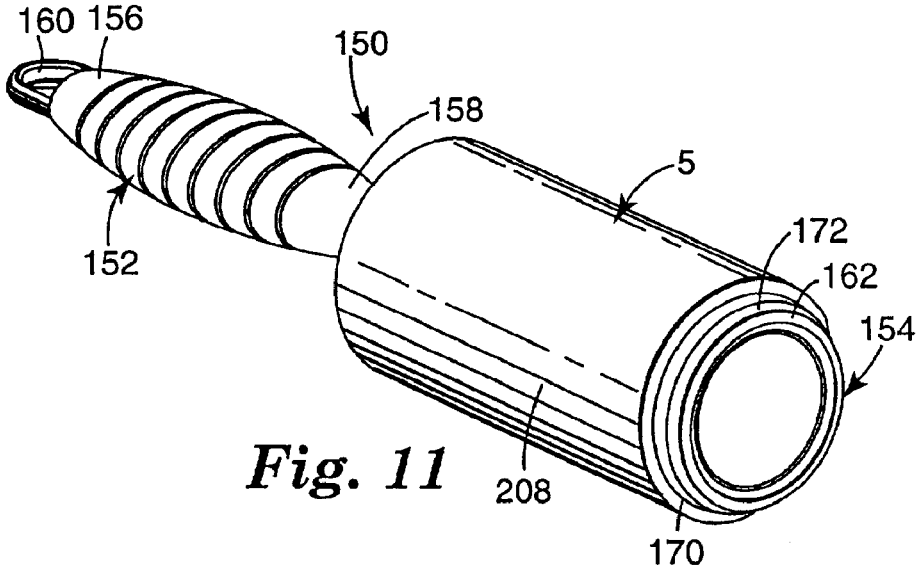
FIG. 11 is a perspective view of the roll of contaminant removal tape made by the apparatus of FIG. 1 mounted on the applicator of FIG. 10 to provide one embodiment of the contaminant removal assembly.

FIGS. 9 and 10 illustrate one embodiment of the applicator 150. The applicator 150 includes the handle portion 152 and the tape-receiving portion 154. The roll 5 of contaminant removal tape 208 can be used by sliding the roll 5 onto the tape-receiving portion 154 of the applicator 150. FIG. 11 illustrates the roll 5 of contaminant removal tape 208 on the applicator 150 to provide a contaminant removal tape assembly.

The handle portion 152 can have any shape and can be contoured to ergonomically fit a hand. The handle portion 152 has a free end 156 and a connecting end 158. The free end 156 can have an opening 160 to permit hanging the applicator 150 on a hook for storage.

The tape-receiving portion 154 also includes a free end 162 and a connecting end 164. The connecting end 158 of the handle portion 152 is connected to the connecting end 164 of the tape-receiving portion 154. The tape-receiving portion 154 also includes a cylindrical tape receiving surface 166, which extends between the free end 162 and the connecting end 164. The tape-receiving surface 166 extends for the entire width of a tape roll 5 and provides support along substantially the entire surface of the tape roll. Preferably, there are no openings, gaps, or notches on which a tape roll could catch or snag to damage the roll. However, the tape-receiving surface 166 need not be cylindrical. It could be formed of planar or curved sides meeting in edges that assist in holding the tape roll 5 in position.

An inner lip 168 is adjacent the connecting end 164, and an outer lip 170 adjacent the free end 162 on the tape-receiving portion 154. Both lips 168, 170 extend radially beyond the tape-receiving surface 166.

The outer lip 170 has a tapered portion 172 on the side facing the free end 162 of the tape-receiving portion 154. The taper is in a direction in which the diameter increases from the free end toward the connecting end. This facilitates applying a roll on the applicator. The tapered portion can be at an angle of from 5° to 15° to a line parallel to the tape-receiving surface 166. This taper permits a tape roll 5 to be applied over the outer lip 170 without damaging the inner wraps of tape and ruining the tape roll.

The outer lip 170 can be perpendicular to the tape-receiving portion 154 on the side 174 facing the handle portion 152. After a tape roll 5 traverses over the outer lip 170, it is in place on the tape-receiving surface 166.

If the tape roll 5 is coreless and is stretchable, it can be stretched over the slightly oversized and tapered outer lip 170, which can optionally be compressible and flexible. In one embodiment of the invention, maximum diameter of the outer lip is more than 5% bigger than the diameter of the tape-receiving portion; the inner diameter of the tape roll 5 is bigger than the diameter of the tape-receiving portion 154 (which must not be too big to permit the tape roll 5 to rotate) and smaller than the maximum diameter of the outer lip 170. Once the roll 10 is in place, the tape recovers to its original size and resides in the recessed area of the tape-receiving surface 166 (between the inner lip 168 and the outer lip 170) which is slightly oversized to allow seating of the roll 10 of tape 208.

The inner and outer lips have grooves 176, 178 in the tape-receiving surface 166 to hold the tape roll 5 in place, so that the tape roll 5 cannot be removed except by dispensing the total roll, that is all of the sheets of a coreless roll (or compressing the outer lip 170). The grooves 176, 178 extend completely around the tape-receiving surface 166 and prevent the tape roll 5 from bending upward over the respective inner and outer lips 168, 170. The grooves cause the tape roll 5 to bend into, the groove when forced toward the lips 168, 170 and retains the tape 208 in proper alignment on the tape-receiving surface 166. Typically, up to eight layers of tape would be retained by the grooves 176, 178.

The roll 5 of contaminant removal tape 208 is not illustrated as including a core or any support material. However, roll 5 may optionally include a core, where the multiple wraps of contaminant removal tape 208 would be wound about the core. Roll 5 may include an optional liner interposed between multiple wraps of tape 208.

The contaminant removal tape 208 is illustrated as having the layer of adhesive coated across the entire width of the contaminant removal tape 208. Alternatively, the tape 208 may include one or any number of non-adhesive zones. These non-adhesive zones would help the user separate the outer wrap of tape 208 from the roll 5. A first non-adhesive zone could run along the first edge of the length of the contaminant removal tape 208. A second non-adhesive zone could run along the second edge of the length of the contaminant removal tape 208, opposite the first non-adhesive zone. Both non-adhesive zones could run along the length of the contaminant removal tape 208 opposite each other with the layer of adhesive 206 located in between. The non-adhesive zones could be first adhesive coated, along with the rest of the tape, and then detackified by using waxes, lacquers, or inks, for example. Alternatively, the first and second non-adhesive zones could be left uncoated-by adhesive.

The present invention has now been described with reference to several embodiments thereof. The foregoing detailed description and examples have been given for clarity of understanding only. No unnecessary limitations are to be understood therefrom. All patents and patent applications cited herein are hereby incorporated by reference. It will be apparent to those skilled in the art that many changes can be made in the embodiments described without departing from the scope of the invention. Thus, the scope of the present invention should not be limited to the exact details and structures described herein, but rather by the structures described by the language of the claims, and the equivalents of those structures.

What is claimed is:

1. An apparatus for forming a roll of contaminant removal tape, comprising:

a turret assembly including a first winding cylinder;

a first vacuum source providing vacuum to said first winding cylinder; and a web breaking assembly movable along a web breaking assembly path between a first web breaking assembly position and a second web breaking assembly position, wherein said web breaking assembly includes a blade, wherein said blade is movable along a blade path between a first blade position and a second blade position, wherein at least one of the web breaking assembly path and the blade path is linear.

2. The apparatus of claim 1, wherein said first winding cylinder travels along a winding cylinder path, wherein said first web breaking assembly position is away from said winding cylinder path and second web breaking assembly position is in said winding cylinder path, and wherein said first blade position is distant from a web path and said second blade position is in said web path.

3. The apparatus of claim 2, wherein said web breaking assembly further comprises:

a first actuator for moving said web breaking assembly between said first web breaking assembly position and said second web breaking assembly position; and a second actuator for moving said blade between said first blade position and said second blade position.

4. The apparatus of claim 2, wherein said turret assembly further includes a second winding cylinder, and wherein said second winding cylinder travels along said winding cylinder path.

5. The apparatus of claim 2, wherein said first winding cylinder includes a first end, a second end opposite said first end, a cylinder wall, and a plurality of holes in said cylinder wall, wherein said first end is attached to said turret assembly, wherein said first vacuum source provides vacuum to said first end of said first winding cylinder and to said plurality of holes; and wherein said apparatus further comprises a support arm assembly, wherein said support arm assembly is movable between a first position distant from said second end of said first winding cylinder and a second position to engage with said second end of said first winding cylinder.

6. The apparatus of claim 5, wherein said apparatus includes a second vacuum source for providing vacuum to said second end of said first winding cylinder and to said plurality of holes.

7. The apparatus of claim 5, wherein said turret assembly further includes a second winding cylinder, and wherein said second winding cylinder travels along said winding cylinder path, wherein said support arm assembly includes an extension member for engaging with said second end of said first winding cylinder, wherein said extension member is movable between said first position distant from said second end of said second winding cylinder and said second position to mate with said second end of said second winding cylinder.

8. The apparatus of claim 2 further comprising a web guide movable between a first web guide position and a second web guide position, wherein said first web guide position is away from said winding cylinder path and second web guide position is in said winding cylinder path.

9. The apparatus of claim 8, wherein said web guide is attached to said web breaking assembly, wherein said web guide and said web breaking assembly are movable together between said first position and said second position.

10. The apparatus of claim 1, wherein said apparatus includes a length of contaminant removal tape, wherein said length of tape includes a first side and a second side opposite said first side, wherein said second side includes a layer of adhesive, and said tape is wrapped around said first winding cylinder such that said layer of adhesive faces outwardly from said first winding cylinder.

11. An apparatus for forming a roll of contaminant removal tape, comprising:

a turret assembly including a first winding cylinder, wherein said first winding cylinder includes a first end, a second end opposite said first end, a cylinder wall, and a plurality of holes in said cylinder wall, and wherein said first end is attached to said turret assembly;

a first vacuum source wherein said first vacuum source provides vacuum to said first end of said first winding cylinder and to said plurality of holes; and a support arm assembly wherein said support arm assembly is movable between a first position distant from said second end of said first winding cylinder and a second position to engage with said second end of said first winding cylinder.

12. The apparatus of claim 11, wherein said apparatus includes a second vacuum source for providing vacuum to said second end of said first winding cylinder and to said plurality of holes.

13. The apparatus of claim 11, wherein said support arm assembly includes a extension member for engaging with said second end of said first winding cylinder, wherein said extension member is movable between said first position distant from said second end of said first winding cylinder and said second position to mate with said second end of said first winding cylinder.

14. The apparatus of claim 11 further comprising an actuator for moving said extension member between said first position and said second position.

15. The apparatus of claim 11 further comprising a web breaking assembly movable between a first web breaking assembly position and a second web breaking assembly position, wherein said web breaking assembly includes a blade, wherein said blade is movable between a first blade position and a second blade position.

16. The apparatus of claim 15, wherein said first winding cylinder travels along a winding cylinder path, wherein said first web breaking assembly position away from said winding cylinder path and said second web breaking assembly is in said winding cylinder path, and wherein said first blade position is distant from a web path and a said second blade position is in said web path.

17. The apparatus of claim 16 further comprising:

a web guide movable between a first web guide position and a second web guide position, wherein said first web guide position is away from said winding cylinder path and said second web guide position is in said winding cylinder path.

18. The apparatus of claim 17, wherein said web guide is attached to said web breaking assembly, wherein said web guide and said web breaking assembly are movable together between said first position and said second position.

19. The apparatus of claim 11, wherein said cylinder wall includes a first surface and a second surface opposite said first surface, wherein said second surface faces outwardly from said first winding cylinder, wherein said plurality of holes in said first winding cylinder have a first diameter in said first surface an a second diameter in said second surface, and wherein said second diameter is greater than said first diameter.

20. The apparatus of claim 11, wherein said apparatus includes a length of contaminant removal tape, wherein said length of tape includes a first side and second side opposite said first side, wherein said second side includes a layer of adhesive, and said tape is wrapped around said first winding cylinder such that said layer of adhesive faces outwardly from said first winding cylinder.

21. An apparatus for forming a roll of contaminant removal tape, comprising:

a turret assembly including a first winding cylinder, wherein said first winding cylinder travels along a winding cylinder path;

a web breaking assembly arranged relative to said turret assembly to selectively break a web being wound about said first winding cylinder as a roll; and a web guide movable between a first web guide position and a second web guide position, wherein said first web guide position is away from said winding cylinder path and said second web guide position is in said winding cylinder path, and further wherein said web guide is arranged relative to said turret assembly to contact the roll being wound about said first winding cylinder.

22. The apparatus of claim 21, wherein said web guide and said web breaking assembly are movable together between said first position and said second position.

23. The apparatus of claim 22, wherein said web guide is attached to said web breaking assembly.

24. The apparatus of claim 23, wherein said web guide includes a roller for guiding the web between said web guide and said first winding cylinder after said winding cylinder has moved from a first position to a second position along said winding cylinder path.

25. The apparatus of claim 21, wherein said web breaking assembly is movable between a first web breaking assembly position and a second web breaking assembly position, wherein said web breaking assembly includes a blade, wherein said blade is movable between a first blade position and a second blade position.

26. The apparatus of claim 25, wherein said first winding cylinder travels along a winding cylinder path, wherein said first web breaking assembly position is away from said winding cylinder path and said second web breaking assembly position is in said winding cylinder path, and wherein said first blade position is distant from a web path and said second blade position is in said web path.

27. The apparatus of claim 21 further comprising a first vacuum source and a second vacuum source, wherein said first winding cylinder includes a first end, a second end opposite said first end, a cylinder wall, and a plurality of holes in said cylinder wall, wherein said first end is attached to said turret assembly, wherein said first vacuum source provides vacuum to said first end of said first winding cylinder and to said plurality of holes, and wherein said second vacuum source provides vacuum to said second end of said first winding cylinder and to said plurality of holes; and wherein said apparatus further comprises a support arm assembly, wherein said support arm assembly is movable between a first position distant from said second end of said first winding cylinder and a second position to engage with said second end of said first winding cylinder.

28. The apparatus of claim 21, wherein said apparatus includes a length of contaminant removal tape, wherein said length of tape includes a first side and second side opposite said first side, wherein said second side includes a layer of adhesive, and said tape is wrapped around said first winding cylinder such that said layer of adhesive faces outwardly from said first winding cylinder.

29. An apparatus for forming a roll of contaminant removal tape, comprising:

a turret assembly including a first winding cylinder and a second winding cylinder, wherein said first winding cylinder includes a first end, a second end opposite said first end, a cylinder wall, and a plurality of holes in said cylinder wall, wherein said first end of said second winding cylinder is attached to said turret assembly, wherein said second winding cylinder includes a first end, a second end opposite said first end, a cylinder wall, and a plurality of holes in said cylinder wall, wherein said first end of said second winding cylinder is attached to said turret assembly;

a first vacuum source providing vacuum to said first end of said first winding cylinder and to said plurality of said holes;

a web breaking assembly movable between a first web breaking assembly position and a second web breaking assembly position, wherein said web breaking assembly includes a blade, wherein said blade is movable between a first blade position and a second blade position;

a second vacuum source for providing vacuum to said second end of said first winding cylinder and to said plurality of holes;

a support arm assembly, wherein said support arm assembly includes an extension member for engaging with said second end of said second winding cylinder, wherein said extension member is movable between a first position distant from said second end of said second winding cylinder and a second position to engage with said second end of said second winding cylinder to provide vacuum to said second end of said second winding cylinder and to provide mechanical support to said second end of said second winding cylinder; and a web guide movable between a first web guide position and a second web guide position, wherein said first web guide position is away from said winding cylinder path and said second web guide position is in said winding cylinder path, wherein said web guide is attached to said web breaking assembly, and wherein said web guide and said web breaking assembly are movable together between said first position and said second position.

30. A method of forming a roll of contaminant removal tape, comprising:

a) winding a length of contaminant removal tape into a first roll about a first cylinder, wherein the first cylinder is movable between a first position and a second position along a cylinder path;

b) providing a web breaking assembly linearly movable between a first position and a second position along a web breaking assembly path, wherein the web breaking assembly includes a blade linearly movable between a first blade position and a second blade position along blade path, wherein said first blade position is distant from the web and said second blade position is to break the web into a first length and a second length;

c) moving the web breaking assembly from the first position in the cylinder path to the second position distant from the cylinder path;

d) moving the first cylinder from the first position to the second position along the cylinder path;

e) moving the web breaking assembly from the second position distant from the cylinder path to the first position in the cylinder path; and f) providing a second cylinder, wherein the second cylinder is movable between a first position and a second position along the cylinder path.

31. The method of claim 30, further comprising the steps of:

g) contacting the length of tape about the second cylinder; and h) linearly moving the blade from the first blade position to a second blade position to break the web into a first length and a second length.

32. The method of claim 31, further comprising the steps of:

i) winding the second length of tape into a second roll about the second cylinder; and j) removing the first roll of tape from the first cylinder.

33. The method of claim 32, wherein steps (a)–(j) are repeated.

34. The method of claim 30, wherein the length of contaminant removal tape includes a first side and second side opposite the first side, wherein the second side includes a layer of adhesive, and wherein step a) comprises winding the length of tape such that the layer of adhesive faces outwardly from the roll.

35. A method of forming a roll of contaminant removal tape, comprising:

a) winding a length of contaminant removal tape into a first roll about a first cylinder, wherein the first cylinder includes a first end, a second end opposite the first end, a cylinder wall and a plurality of holes in the cylinder wall;

b) providing a vacuum to the first end of the first cylinder and to said plurality of said holes;

c) moving a support arm assembly from a first position distant from the second end of the first cylinder to a second position to engage with the second end of the first cylinder to support the second end of the first cylinder;

d) thereafter breaking the length of tape with a web breaking assembly; and e) moving the support arm assembly from the second position to the first position.

36. The method of claim 35, comprising the step prior to step c) of:

moving the cylinder from a first position to a second position along a cylinder path and contacting the length of tape about a second cylinder.

37. The method of claim 35, comprising the step prior to step d) of:

providing a vacuum to the first end and second end of the first cylinder and to said plurality of holes.

38. The method of claim 35, wherein the length of tape includes a first side and second side opposite the first side, wherein the second side includes a layer of adhesive, and wherein step a) comprises winding the length of tape such that the layer of adhesive faces outwardly from the roll.

39. An apparatus for forming a roll of contaminant removal tape, comprising:

a turret assembly including a first winding cylinder, said first winding cylinder defining a first end attached to said turret assembly and a second end, wherein said first winding cylinder travels along a winding cylinder path; and a support arm assembly, wherein said support arm assembly is movable between a first position distant from said second end of said first winding cylinder and a second position to engage with said second end of said first winding cylinder.

40. A method of forming a roll of contaminant removal tape, comprising:

winding a length of contaminant removal tape into a first roll about a first cylinder, wherein said first cylinder includes a first end and a second end opposite said first end;

moving a support arm assembly from a first position distant from said second end of said first cylinder to a second position to engage with said second end of said first cylinder to support said second end of said first cylinder; and moving said support arm assembly from said second position to said first position.

* * * * *

UNITED STATES PATENT AND TRADEMARK OFFICE

CERTIFICATE OF CORRECTION

PATENT NO. : 6,908,525 B2
DATED : June 21, 2005
INVENTOR(S) : Anderson, Andrew C.

It is certified that error appears in the above-identified patent and that said Letters Patent is hereby corrected as shown below:

Column 10,
Line 12, delete “fist” and insert -- first --, therefor.

Column 12,
Line 52, delete “to” before “periodic”.

Column 14,
Line 12, after “approximately” insert -- 1.1 --.

Signed and Sealed this

Eighth Day of November, 2005

JON W. DUDAS
*Director of the United States Patent and Trademark Office*